US007896344B2

(12) United States Patent
Nakada et al.

(10) Patent No.: US 7,896,344 B2
(45) Date of Patent: Mar. 1, 2011

(54) AUTOMATIC SELF-CLEARING FEATURE FOR PAPER JAMS IN MARKING MACHINES

(75) Inventors: Joyce Kay Nakada, Rochester, NY (US); Shahana Rahman, Webster, NY (US); David P. Rich, Brockport, NY (US); David L. Nelson, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 449 days.

(21) Appl. No.: 11/542,493

(22) Filed: Oct. 3, 2006

(65) Prior Publication Data

US 2008/0079210 A1 Apr. 3, 2008

(51) Int. Cl.
*B65H 39/10* (2006.01)

(52) U.S. Cl. ..... 271/303; 271/902; 399/21

(58) Field of Classification Search ..... 271/303, 271/902; 399/21

See application file for complete search history.

(56) References Cited

U.S. PATENT DOCUMENTS

| | | | | |
|---|---|---|---|---|
| 4,078,787 | A | 3/1978 | Burlew et al. | |
| 4,231,567 | A | 11/1980 | Ziehm | |
| 4,614,867 | A * | 9/1986 | Lane | 250/223 R |
| 4,867,431 | A * | 9/1989 | Hosking et al. | 241/3 |
| 5,142,340 | A * | 8/1992 | Farrell et al. | 399/327 |
| 5,421,463 | A * | 6/1995 | Okazaki et al. | 209/559 |
| 5,810,173 | A * | 9/1998 | Stevens et al. | 209/539 |
| 6,010,127 | A | 1/2000 | DiCesare et al. | |
| 6,139,011 | A | 10/2000 | Huang et al. | |

* cited by examiner

*Primary Examiner* — Stefanos Karmis
*Assistant Examiner* — Thomas A Morrison
(74) *Attorney, Agent, or Firm* — Ronald E. Prass, Jr.; Prass LLP

(57) ABSTRACT

This is a system that enables a marking system to automatically clear itself of paper jams even when the marking system is unattended. The paper transport is enabled to move forward and backward, and when a jam occurs it will automatically move backward or in reverse direction until the jam is cleared. Sensors indicate where the jam is and when it is cleared.

5 Claims, 3 Drawing Sheets

AUTOMATIC SELF-CLEARING FEATURE FOR PAPER JAMS IN MARKING MACHINES

This invention relates to marking systems and machines, including those moving paper or other media and, more specifically, to an apparatus and system for attending to the clearance of jammed paper or other receiving sheets in said marking systems.

BACKGROUND

In systems marking receiving members, such as paper products, Mylar and other flexible media, the paper sometimes jams in the travel path and disrupts or stops the entire marking system. In some systems used today, manual clearing of these jams is used with manual access to the sheet transport used. Included in "marking machines" are printers, copiers, fax, and other paper handling marking machines or systems.

For purposes of clarity, the system of the present invention will be described in reference to an electrostatic marking system; however, any marking systems where paper or other flexible media are transported internally are included within the scope of this invention.

In one embodiment where the process of electrostatic reproduction is used, a light image of an original to be copied or printed is typically recorded in the form of a latent electrostatic image upon a photosensitive member with a subsequent rendering of the latent image visible by the application of electroscopic marking particles, commonly referred to as toner. The visual toner image can be either fixed directly upon the photosensitive member or transferred from the member to another support medium such as a sheet of plain paper. To render this toner image permanent, the image must be "fixed" or "fused" to the paper, generally by the application of heat and pressure.

With the advent of high speed Xerography, or other marking machines wherein these machines can produce at a rate in excess of three thousand copies per hour, there is a need for a reliable sheet-handling system. For example, this reliability is needed in systems feeding paper or other media through various processing stations in a rapid succession. This is important to utilize the full capabilities of the relatively expensive marking machines. These sheet-handling systems must operate flawlessly to virtually eliminate risk of damaging the receiving sheets and generate minimum machine shutdowns due to paper jams, misfeeds or multifeeds. Jamming can occur for a variety of reasons, such as worn nips in rollers, moisture, faulty sensors and, in some cases, can be due to up curl and down curl in sheets which generally occur randomly in the document stack. With the high speed marking machines used today, rapidly traveling paper along a paper path that is, for some reason, interrupted by a paper jam can cause significantly longer and more damage and downtime than in heretofore slower systems.

As noted, earlier in marking machines, paper jams have long been a serious problem and have become a more serious problem in today's high-speed machines. When a paper jam occurs, the entire marking system is down costing the user valuable time and expense until the jam is fixed. Heretofore, various manual strategies and features have been developed to reduce the occurrence of jams and to minimize the burden on the user to recover from the jam. Some of these strategies include: early detection of fault conditions; controlled cycle down and cycle up of machines; manually purging "bad" sheets which may be damaged or out of sequence to a destination where they are easily recognized and separated from "good" sheets and minimizing the number of steps and the number of sheets and the difficulty of removing paper from the jammed machine.

In some instances, sheets not affected or downstream from the jam can be delivered as good and reusable and sheets upstream from the jam must be maintained in the system apart from the jammed sheets. Purged sheets must then be recognized by the user as "bad" and discarded using an output destination, such as a "purge tray".

Incorporated by reference herein is U.S. Pat. No. 4,078,787 which discloses a paper jam technique in a copier that causes a complete shutdown of the machine. Copier jam recovery is accomplished by manually opening the machine access covers, removing the jammed sheets and closing the covers. In U.S. Pat. No. 4,231,567, a method and apparatus for clearing jams in the transport path of a copier includes the steps of sensing a jam, clustering in-process sheets either at the jam location or at an area upstream of the jam location while simultaneously allowing sheets downstream of the jam location to continue.

In U.S. Pat. No. 6,010,127, a buckle chamber is provided along a sheet path where jammed sheets are compiled during a down cycle during a paper jam.

Usually, a jam in a marking machine or printer is defined as a sheet or sheets of paper in the paper path which has either stayed too long at one station (sensor), or has not reached the next station (sensor) within a pre-defined specific period of time. These conditions are determined by optical sensors used where each sheet in the path is sensed and, because of these sensors, the machine subsequently will be able to detect automatically if the self-clearing action was effective. Once a jam is detected in a marking machine the system shuts down and an operator is instructed to clear the jammed sheet and the remaining paper from the machine. The machine will "wait" until the paper path has been successfully cleared by the operator prior to attempting to restarting the job. The present invention provides that once a jam condition is detected and the system has shut down, the machine itself will automatically attempt to clear the jammed sheet(s) and any other sheets in the paper path. This would be accomplished by at least part of the paper path automatically reversing itself (i.e. at least some of the drive motors are run in the reverse direction) for a predetermined time while baffles are used or gates are actuated to direct the "jammed" sheets out of the paper path and into a waste area for disposal later (or exit the machine). The baffles are passive and need not be actuated, whereas the gates need to be actuated. This procedure will occur in even unattended marking machines. Once the machine has successfully cleared itself of the jammed and other sheets, it would automatically restart the job and resume normal operations. This would allow the operator to have the machine function unattended and return to pick up their completed job at a later time without having to worry about the possibility of jamming and not completing their job. If the machine attempted several times to clear the jam and was unsuccessful, it would declare a continuing jam and the operator would be instructed how to clear the jam in the usual manual manner.

SUMMARY

Embodiments of this invention would enable the marking machine or system to clear itself when paper jams occur. In a system with configurable paper paths, a reverse paper path, made for clearing paper jams, would be incorporated into the design of the machine. After a jam stopped the machine, paper involved in the jam would automatically be directed in the reverse direction, using reversible gates and baffles, to a purge tray or an exit outside the paper path. In a longer paper path, this would at least allow the automatic clearing of numerous sheets of undamaged paper. Even damaged paper that is only crumpled at one end might be able to travel in the reverse direction to a purge tray. At worst, the one damaged sheet might need to be cleared manually if the present procedure is only partially successful. In those machines where each sheet in the path is sensed, the machine will be able to detect the jam location and if the self-clearing action was effective.

All of the damaged sheet(s) may or may not be cleared by running backwards. However, since machines currently used provide that each sheet is under an optical sensor at all times, the machine will know which sheet caused the jam and is likely to be damaged. The machine will also know immediately if the attempt to clear the jam has failed and will so indicate. Embodiments of the present invention may be used alone or in conjunction with manual means to clear a jam.

Current technology allows sheets to run backwards, if the paper path is designed from the outset to be bi-directional, with reversible motors and baffles that allow paper to move in either direction. Appropriate software would allow these systems to be used in the present invention. This invention would be a substantial incentive for customers and a selling point for providers of marking machines. It is particularly useful for machines with long paper paths.

Clearing paper jams is a huge inconvenience for customers, consuming the machine user's valuable time and creating animosity in the user towards both the machine and the machine manufacturer or provider.

An especially critical issue is that from the time of the paper jams to the time that the jam is manually cleared, the relatively expensive machine is unavailable for use. Especially when using redundant paper paths, it would be desirable to avoid breaking the power supply interlocks on modules that could otherwise still be running.

To automatically clear even just the undamaged sheets would lead to savings in time and effort. Embodiments of this invention provide that the jammed sheets could pass via a baffle or gate to a purge tray or other exit means when running in the reverse direction with the undamaged part of the sheet as the leading edge. However, if a damaged sheet could not make it to the purge tray, the machine could still detect where it was and the user would simply only need to manually clear the one damaged sheet.

DETAILED DISCUSSION OF DRAWINGS AND PREFERRED EMBODIMENTS

Figure 1:
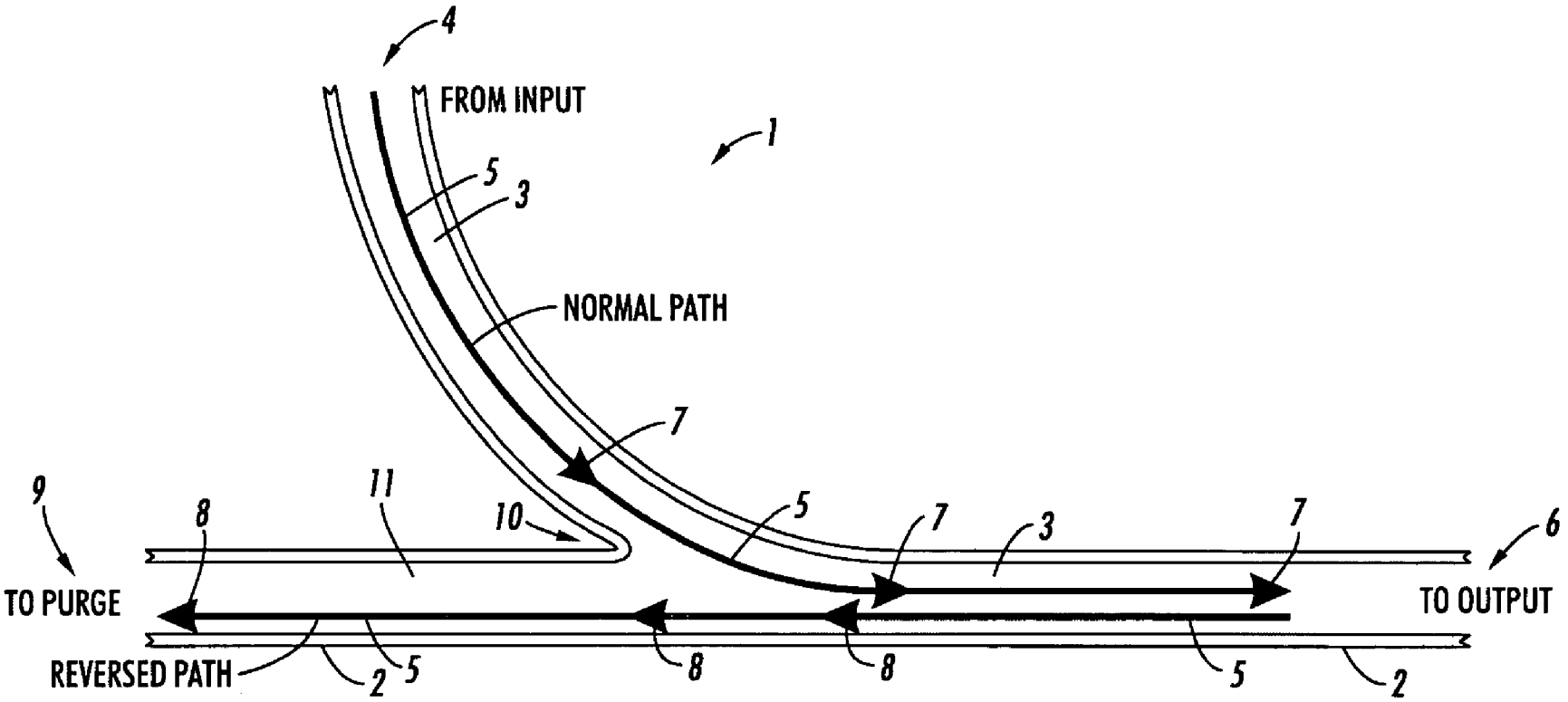
FIG. 1 illustrates an embodiment where both the normal paper path and reverse path are shown using a baffle diverter.

In FIG. 1, a paper-moving assembly of a marking system is shown having sheet transport component 2 which travels along a sheet transport path 3. A sheet-feeding component 4 feeds paper 5 (or other media) from a paper source (not shown). When the marking system is in a normal operation, the paper 5 travels forward as shown by arrows 7 toward sheet output 6. When a paper jam occurs, the moving assembly 1 goes into a reverse or backward direction as shown by arrows 8 and jammed paper is moved in a reverse direction toward purge 9. A diverting baffle 10 permits paper 5 in a normal operation to travel along a normal path 3 and baffle 10 diverts paper 5 to a purge when clearing a jam and when the transport component 2 is in the reverse mode. Normally, paper 5 enters from the top of the path and exits to the right toward output 6. In a jam situation, the paper 5 runs backward as shown in arrows 8, entering from the right and exiting to the left toward purge 9. Care must be given to the configuration of the baffle 10 to accommodate very light or curled paper sheets 5.

In FIG. 1 is shown a paper-moving assembly 1 useful in an electrostatic marking system. This paper-moving assembly 1 comprises a sheet-feeding component 2 configured to feed paper 5 via 3 from a paper source (not shown). The assembly 1 comprises at least one sensor and controller 14 (see FIG. 3), a sheet output path 7 which is coextensive with a sheet purge path 8 and in a paper feed arrangement with the sheet-feeding component 3. This sheet output path 7 and the sheet purge path 8 are separated by a baffle-diverter 10.

This diverter 10 is configured to permit the paper 5 to travel in a normal direction 7 toward a sheet output 6. The diverter 10 also is configured to direct paper 5 to travel in a reverse direction 8 toward a sheet purge outlet or exit 9. The sheet output path 7 is a coextensive path with the sheet purge path 8. The sheet output path has an output 6 on one terminal portion of the coextensive path and a sheet-purge path 8 which has a purge exit 9 on an opposite terminal portion of the coextensive path. The coextensive path is bi-directional and configured to run in both a forward 7 and a reverse direction 11. The forward direction 7 is directed to the sheet output 6.

The bi-directional coextensive path is configured to run in a reverse direction 11 toward the sheet purge outlet or exit 9 and the coextensive path is also configured to move in the forward direction 7 toward the sheet output 6. When a paper jam is detected or occurs, the coextensive path is configured to move in a reverse direction 8 to remove the jammed sheets from the system. The sensors 14 and controllers (see FIG. 3) are configured to stop feeding paper 5 forward toward the sheet output path 7 and put the coextensive path in a reverse direction 8 toward the sheet purge path so that lammed paper exits the paper-moving assembly at the purge exit 9.

The sensors 14 and controller are configured to detect when the paper jam is cleared and configured thereafter to restart the paper-moving assembly 1.

Figure 2:
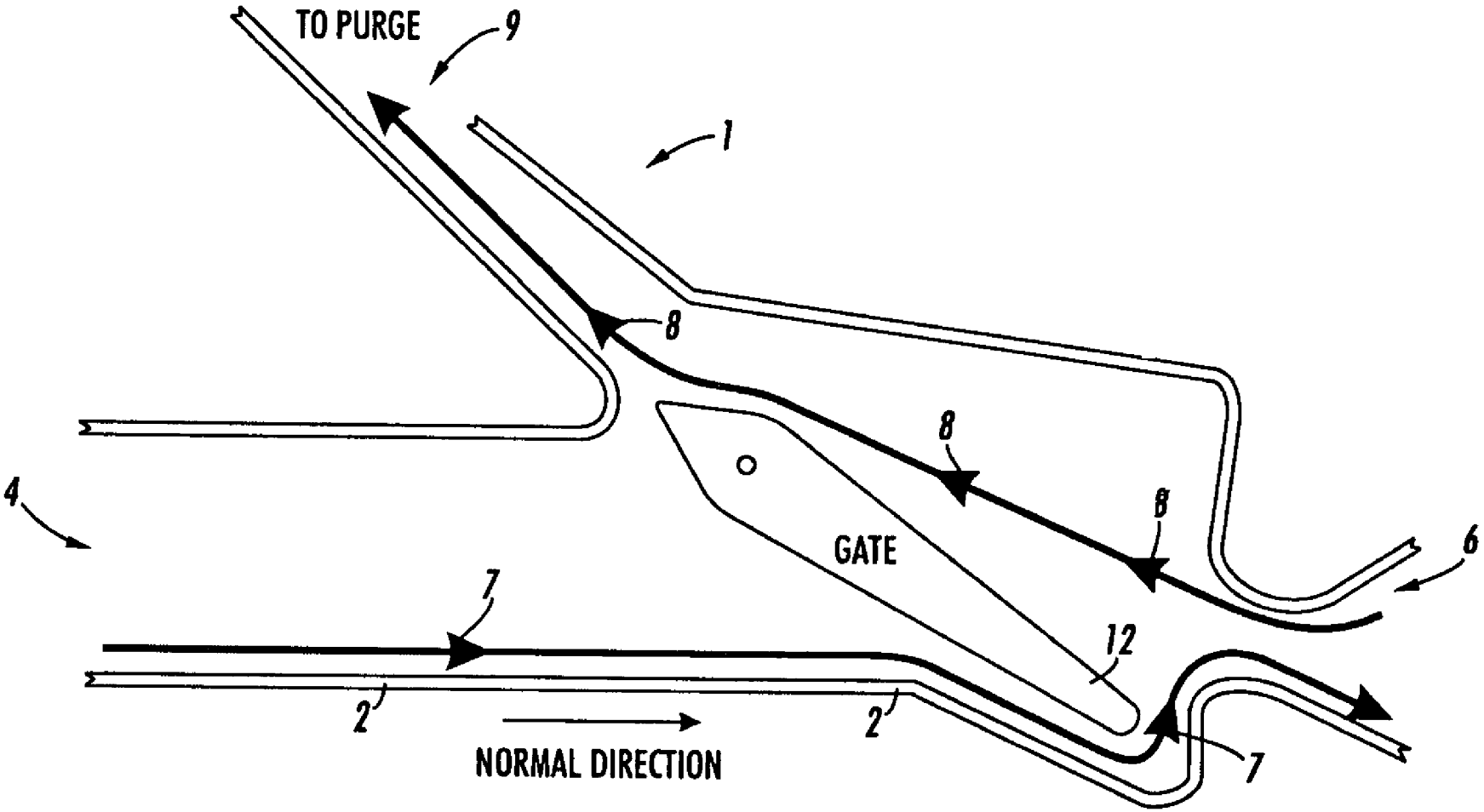
FIG. 2 illustrates an embodiment where both the normal paper path and reverse path are shown using a gate diverter.

In FIG. 2, an active gate 12 is used to divert sheets 5 to a purge tray. Normally, the gate 12 is flipped up and paper 5 enters from the left 4 and exits to the right toward sheet output 6. In a jam situation, the gate 12 is flipped down and paper 5 runs backward as shown by reverse arrows 8, entering from the right and exiting the top at purge 9.

Figure 3:
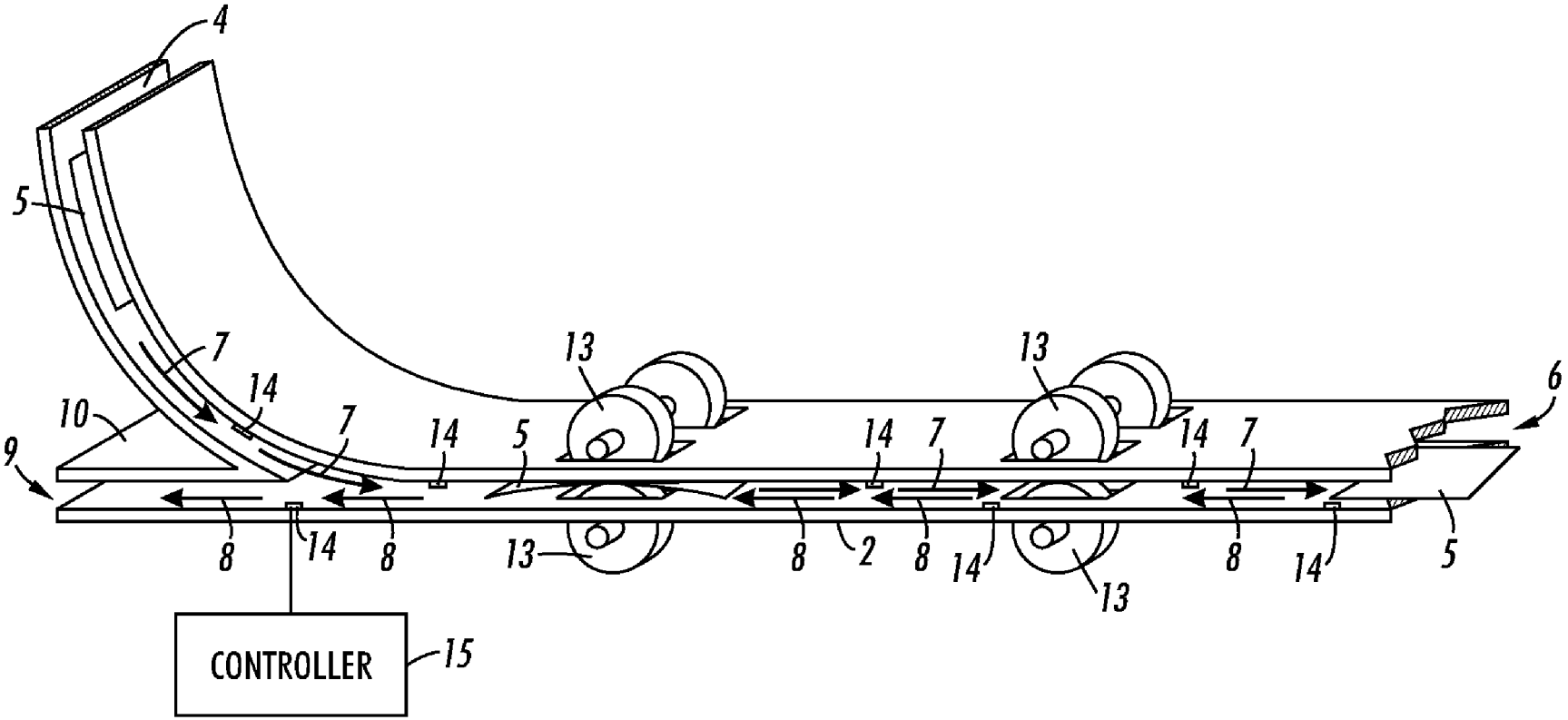
FIG. 3 illustrates a perspective side view of a paper path used in an embodiment of the present invention.

In FIG. 3, a paper transport 2 is shown with rollers 13 which move the transport 2 in both a forward and reverse direction. A source of power is in operative connection to rollers 13 and transport 2 to move them in bi-directional movement. A diverting gate 12 or baffle 10 as shown permits paper 5 when open to travel in a normal direction toward sheet output 6 as shown by normal path arrows 7. When reverse path 11 is in effect, baffle 10 permits paper 5 to travel in a reverse direction as shown by arrows 8 to purge 9 and out of the paper transport 2 (as shown in FIG. 1). Normally, (a gate 12 or a baffle 10 may be used) the gate 12 is flipped down (or baffle 12 remains in place) and sheets 5 enter from the top at feeder 4 and exit to the right at sheet output 6. In a jam situation, the gate 10 is automatically flipped up (or stationary baffle stays in place) and sheets 5 enter from the right and exit downward toward purge 9. Sheets already to the left of baffle 10 (or of gate 10) will exit the system to the left at purge 9. The baffle 10 is stationary (and unlike a gate 12) is not movable as baffle 10 shown in FIG. 3. Otherwise, all other aspects of FIG. 3 are the same, whether a baffle 10 or movable gate 12 is used.

Appropriate software can be used together with sensors 14 to automatically stop the feeding of paper 5 and put the system in a reverse mode so that jammed paper 5 exits the system at purge 9 and restarts when the sensors 14 know the jam is cleared.

Most marking systems have bi-directional motors already as part of the apparatus. The embodiments of this invention with appropriate software can be easily fitted into these existing machines. Gates or baffles need to be installed into the paper path to redirect the "bad" or jammed paper out of the system. The baffles can easily be provided along the paper path to be used in directing jammed paper out of the system when a jam is to be cleared. The gate (if used) would be in the normal position during a forward paper movement, but would be enabled after actuation to scoop up or direct the bad paper during a reverse movement of the transport belt to a purge or collection site outside of the paper path. Once the jam is fixed, the system will automatically be instructed by the controller 15 via the sensors 14 to resume normal operations. The use of diverters such as baffles or gates are used to direct the bad paper out of the paper path. Systems using a plurality of bi-directional motors are needed in the present embodiments. The embodiments of this invention may be used alone or with other jam clearing techniques. Any suitable sensor can be used in embodiments of this invention including optical sensors like Reflective, Photologic, Low Gloss sensors. These type of sensors are available from Eltrex Company or Flextronics Corp. or other providers.

To summarize, the present embodiments provide a marking system comprising in an operative arrangement a sheet-feeding component, a sheet transport component, a sheet transport path and a sheet collection component. The transport path is enabled to travel from the feeding component to the sheet collection component. There are sensors positioned along the transport path to sense locations where sheets may be jammed in the system. The transport component is adapted to be bi-directional and enabled when jams occur to automatically travel in a reverse paper path to clear the paper jams. The transport component is enabled to automatically direct the paper of the jam to a gate or baffle to be directed out of the path and the system.

The paper transport is in operative arrangement with connected motor(s). During a jam, the sensors automatically indicate a jam has occurred and reverse the direction of the transport to correct the jam and direct jammed sheets out of the paper path. Once the jam is cleared, the sensors and controllers in the system are enabled to restart a normal marking process. Also, at least one sensor in the system will indicate a success or non-success of the jam-clearing procedure.

The system uses either or both gates or baffles to direct jammed sheets out of said paper path into a purge tray or a disposal area outside of the paper path.

This paper-moving assembly is useful in an electrostatic and other marking systems. As noted above, the assembly comprises in an operative arrangement, a movable belt along a paper path, a plurality of motors, a plurality of optical sensors, at least one movable baffle or gate, a paper feed and a paper exit from the path. The motors are enabled to move the belt in both a forward and reverse direction. The assembly is adapted to clear a paper jam in the paper path by automatically moving the belt in a reverse direction when the sensors sense a paper jam in the paper path. The baffle or gate is configured so as to permit paper to move in a forward direction during a normal operation and configured to scoop up or divert jammed paper in a paper jam-clearing operation when the belt is in a reverse direction. The assembly is enabled to automatically resume normal operations once the jam is cleared. The at least one sensor component and appropriate software indicate the presence of a jam and the success or non-success of the jam-clearing procedure. These gates or baffles are enabled to direct jammed sheets out of the paper path into a purge tray or a disposal area outside of the paper path or to any other desired location. Obviously, the present system is enabled to be used alone or together with a manual jam clearance. The paper feed is enabled to automatically shut down upon being alerted by the sensors of the formation of a jam and will restart upon clearance of the jam.

While particular embodiments have been described, alternatives, modifications, variations, improvements, and substantial equivalents that are, or, may be presently unforeseen, may arise to applicants or others skilled in the art. Accordingly, the appended claims as filed and as they may be amended are intended to embrace all such alternatives, modifications, variations, improvements and substantial equivalents.

What is claimed is:

1. A method for moving paper in an electrostatic marking system, said method comprising:

providing a paper sheet feeding component to feed paper sheets to said system, providing said paper sheet feeding component to move said paper sheets to a bi-directional sheet transport component disposed on a sheet transport path, said sheet transport path having at one first end a sheet output and at a second opposite end a sheet purge, positioning at least one sensor and controller along said sheet transport path, said at least one sensor and controller configured to stop feeding said paper sheets toward said sheet output and put said bi-directional sheet transport component in a reverse direction toward said sheet purge when a paper jam is detected, positioning a baffle sheet diverter between said sheet output and said sheet purge, directing said sheet diverter via said controller to direct said sheet to said sheet transport path in a forward direction toward said sheet output or in a reverse direction toward said sheet purge, said at least one sensor and controller when sensing a paper jam putting said bi-directional sheet transport component in said reverse direction toward said sheet purge and exiting said paper of said paper jam at said sheet purge, and when said sensor and controller detect that said paper jam is cleared, said sensor and controller will restart said bi-directional sheet transport component to move only in said forward direction toward said sheet output.

2. The method of claim 1 wherein said paper sheet feeding component will automatically shut down when said at least one sensor and controller detect a paper jam and will restart upon a clearance of said paper jam.

3. The method of claim 1 where at least one said sensor will indicate a success or non-success of a paper jam-clearing procedure.

4. The method of claim 1 wherein said sheet during a paper jam is moved backward on said sheet transport path rather than forward until said paper jam is cleared.

5. The method of claim 1 wherein rollers with a source of power are provided along said bi-directional sheet transport component, said rollers configured to move said bi-directional transport component in both a forward and reverse direction when directed by said at least one sensor and controller.

* * * * *